United States Patent [19]

Lamouric

[11] 4,265,037

[45] May 5, 1981

[54] DEVICE FOR ASSEMBLING TOOLS ON A WHEEL, PARTICULARLY CUTTING TOOLS ON A TRENCHING MACHINE

[76] Inventor: Pol Lamouric, B.P. 12, 78 730 Saint Arnoult, France

[21] Appl. No.: 21,239

[22] Filed: Mar. 16, 1979

[30] Foreign Application Priority Data

Mar. 22, 1978 [FR] France ..... 78 08311

[51] Int. Cl.[3] ..... E02F 5/08

[52] U.S. Cl. ..... 37/94; 37/189; 29/802; 51/206.5; 83/838; 74/448; 152/402; 403/344

[58] Field of Search ..... 152/396, 402, 403, 404; 29/802, 803, 159 R, 159.1, 159.2; 74/448, 230.5; 37/94–97; 83/838, 839; 125/15; 51/206.5; 403/344

[56] References Cited

U.S. PATENT DOCUMENTS

| | | | |
|---|---|---|---|
| 152,118 | 6/1874 | Jenkins | 74/230.5 X |
| 291,511 | 1/1884 | Hoehn et al. | 37/94 |
| 426,117 | 4/1890 | Ebert | 403/344 X |
| 1,278,630 | 9/1918 | Freas | 83/838 |
| 2,089,847 | 8/1937 | Greenwood | 51/206.5 |
| 2,212,779 | 8/1940 | Klein | 74/230.5 |
| 2,670,766 | 3/1954 | Hiltebrand | 83/838 |
| 4,048,762 | 9/1977 | Bair, Jr. | 51/206.5 |

FOREIGN PATENT DOCUMENTS

| | | | |
|---|---|---|---|
| 495216 | 8/1950 | Belgium | 83/838 |
| 1022859 | 12/1952 | France | 83/838 |
| 1036364 | 4/1953 | France | 83/838 |

*Primary Examiner*—Clifford D. Crowder
*Attorney, Agent, or Firm*—Fleit & Jacobson

[57] ABSTRACT

The present invention provides a device for assembling tools on a wheel. Stop pins fixed to the wheel cooperate with radial wedges to maintain tool-bearing sectors in a disc formation on the wheel. The pins and the radial wedges are located between adjacent sectors alternatively, with one wedge being positioned between two adjacent faces or ends of adjacent sectors to urge the other ends of the sectors into engagement with two of the pins.

7 Claims, 7 Drawing Figures

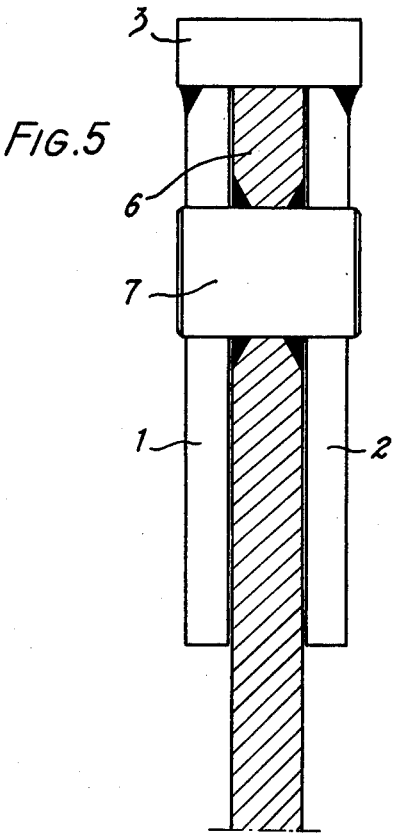
FIG. 5
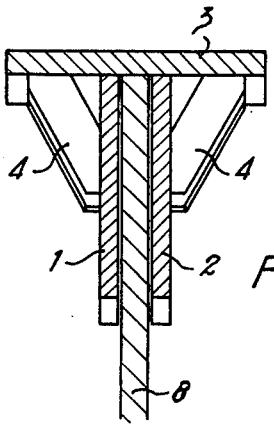
FIG. 3
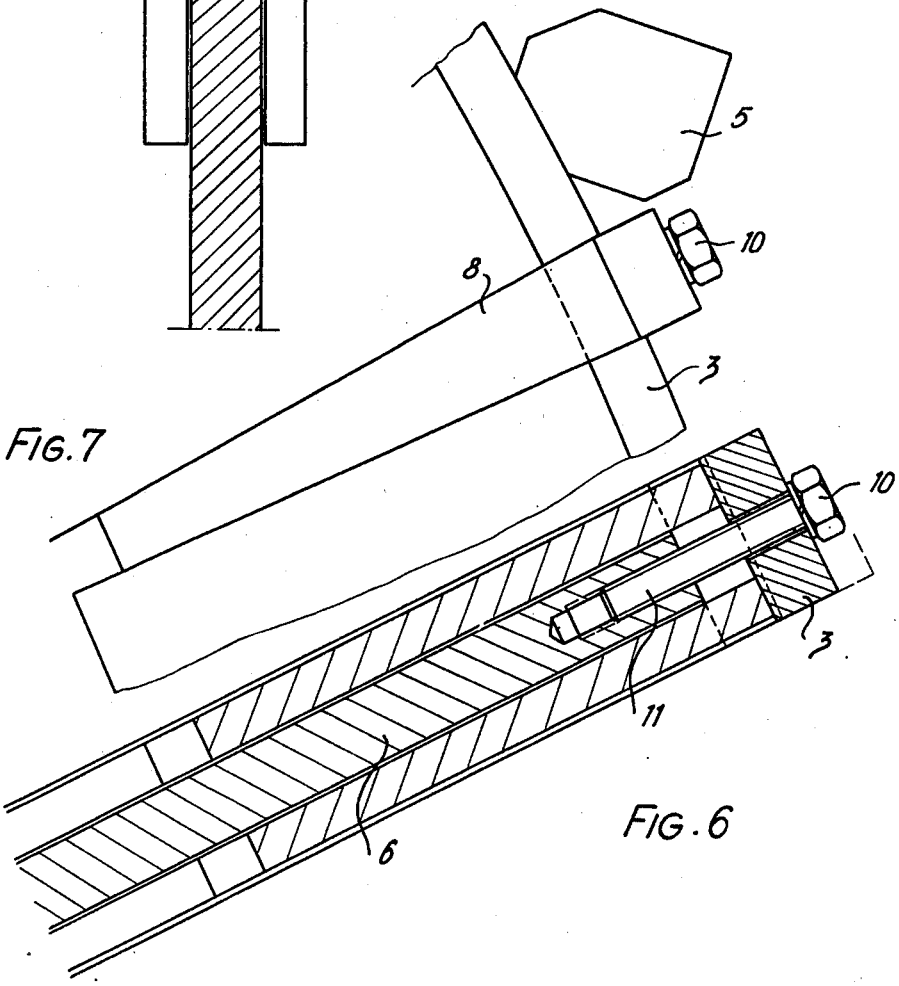
FIG. 7
FIG. 6

DEVICE FOR ASSEMBLING TOOLS ON A WHEEL, PARTICULARLY CUTTING TOOLS ON A TRENCHING MACHINE

The present invention relates to the assembly of tools on a wheel. It is more particularly applied to the assembly of the tools of a trenching machine and will be explained hereinafter with reference to this application. The cutting tools of a trenching machine are generally used under conditions which necessitate frequent changes of said tools which are normally held in place by bolts which pass through the wheel. It is difficult to dismantle the bolts due to the shocks which may have more or less buckled them or damaged the threads of the bolts and, in any case, the operator has to dismantle a plurality of bolts, which means that the saw must be virtually immobilised for several hours.

It is an object of the invention to provide a device for assembling the tools which is less subject to deteriorations, which allows an easier dismantling and which is simple.

This object is attained, according to the invention, by fixing the tools to sectors maintained in circular formation on at least one face of the wheel by means allowing the sectors to be dismantled.

These means preferably comprise keys perpendicular to the wheel and radial wedges.

The invention will be more readily understood on reading the following description with reference to the accompanying drawings, in which:

FIG. 3 is a cross section through the assembly of FIG. 1.

FIG. 5 is a section along AB of FIG. 4.

FIG. 6 is a section along CD of FIG. 4.

FIG. 7 is an enlargement of a wedge according to the invention.

In the device shown, it is provided to arrange sectors on the two faces of the wheel, each sector of one face forming with a corresponding sector of the other face a unit which covers the wheel and which is locked by a key and by a wedge.

Figure 1:
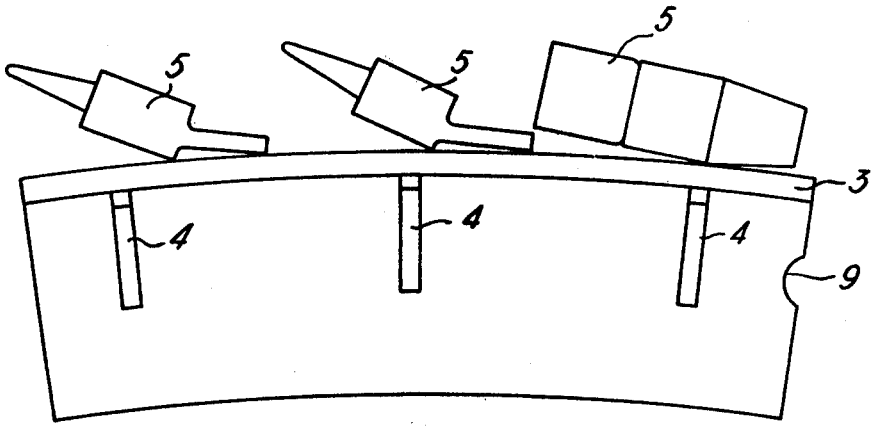
FIG. 1 is a side view of an assembly comprising a pair of sectors.
Figure 2:
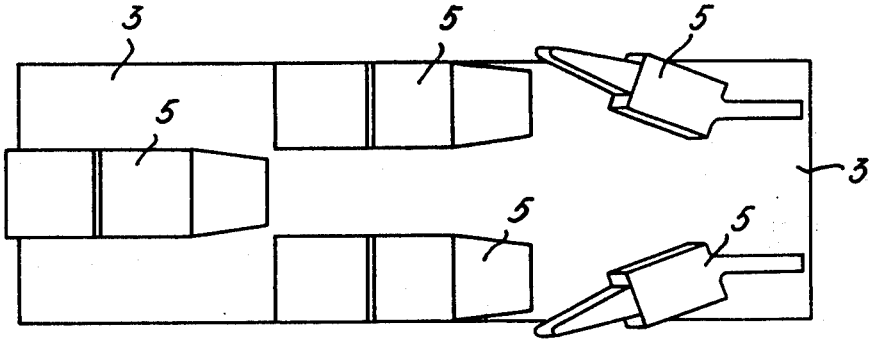
FIG. 2 is a top view of the assembly of FIG. 1.

The assembly shown in FIGS. 1 to 3 thus comprises two associated sectors 1 and 2 constituting disc portions and which are fast with a rim portion 3. Crosspieces 4 possibly reinforce the cohesion of the assembly. Tools 5 are fixed on the rim 3.

The assembly constituted by the sectors 1 and 2 and the rim portion 3 bears a plurality of tools and covers the wheel 6 as is shown in FIG. 3 in particular.

The different assemblies are maintained in position by keys and wedges, as will be more readily understood with reference to FIGS. 4 to 7.

Figure 4:
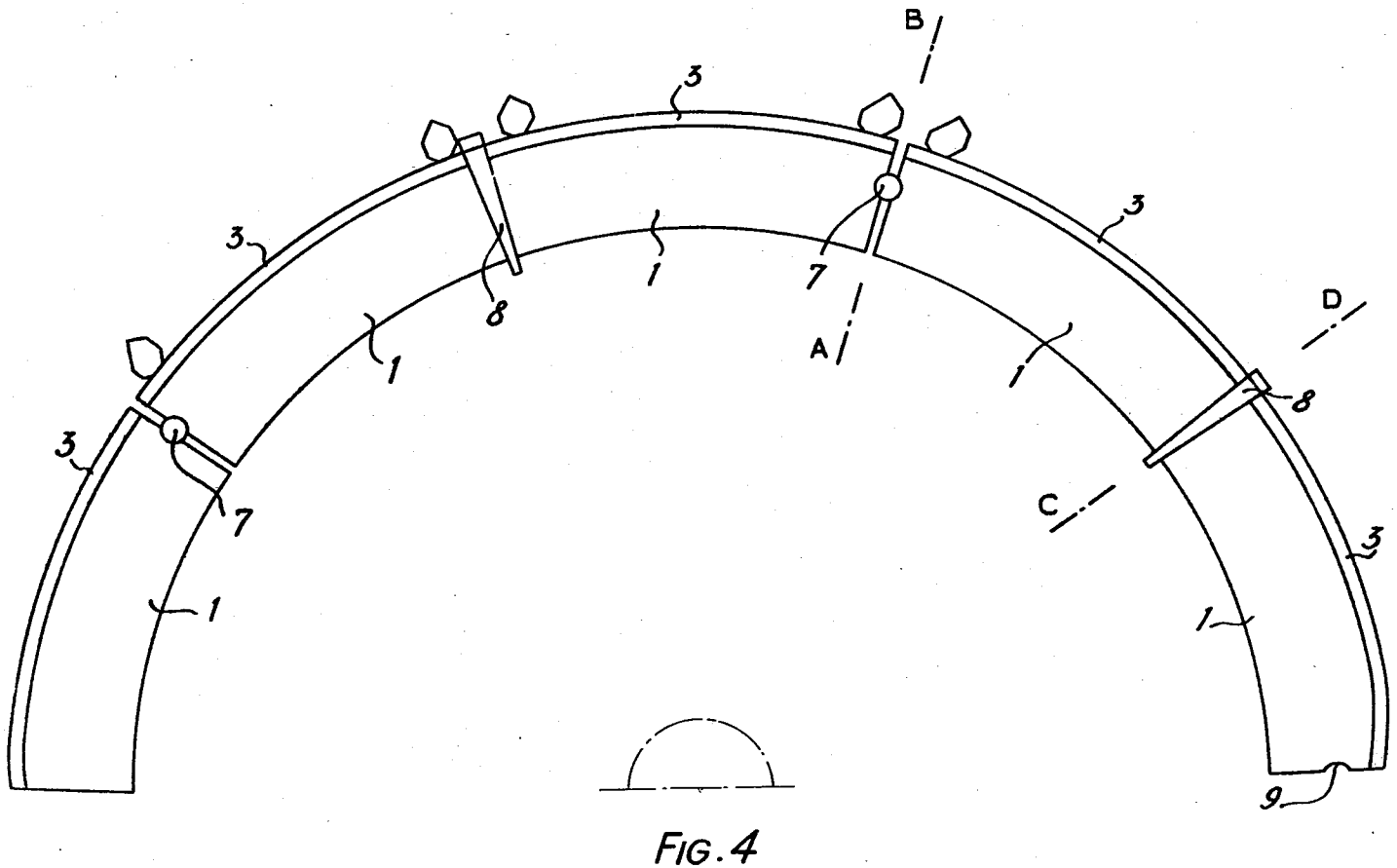
FIG. 4 is a plan view of a semi-circular formation obtained with the aid of the sectors of the invention.

FIG. 4 shows half of the sectors which compose a circular disc formation on one face of the wheel. In the case shown, there are thus five sectors 1 which make a semi-circular formation. Two adjacent sectors 1 are separated either by a transverse key 7 or by a radial wedge 8. More precisely, each sector is in abutment at one end on a key and is blocked at its other end by a wedge which simultaneously blocks this sector and an adjacent sector, in the same way as the key serves as stop simultaneously for a sector and an adjacent sector.

The keys are permanently fixed to the wheel, for example by welding, as shown in FIG. 5.

The end of one sector which is in abutment against the key is preferably provided with a lateral notch 9 which enables the sector to follow the shape of the key.

The wedges 8 are detachably maintained in position, for example by elements screwed in the wheel.

These elements, as may be more clearly seen in FIGS. 6 and 7, comprise bolts 10 of which the heads bear on the wedges in radial direction and of which the shanks 11 are screwed in the wheel.

In the example shown, where the sectors are fast in two's with a rim portion 3, the wedges are perpendicular to this rim portion and portions of the wedges bear on the rim portions.

One key and one wedge are preferably used for each sector or for each assembly of two sectors but this number is not limiting.

It goes without saying that the invention provides that the sectors need not be associated in pairs, and the invention is not limited to the embodiment which has been described.

For example, it is provided to arrange the sectors only on one face of the wheel, using the means of the invention.

The invention provides for the keys and wedges to be constituted by any element performing the desired function. For example, the wedges may be expanding plugs, such as Rawlplugs (Registered Trade Mark).

What is claimed is:

1. A device for assembling tools on a wheel comprising:

sectors to which tools are fixed, each sector having the shape of a portion of a disc; and means for fixing the sectors adjacent to each other on at least one face of a wheel in a disc formation, said fixing means comprising stops connected to the wheel and wedges positioned between adjacent sectors, said stops and wedges being disposed alternatively around the periphery of the at least one face of the wheel, two adjacent sectors being located between two stops and in abutment therewith under the action of one of the wedges radially inserted between adjacent ends of said two adjacent sectors, each of said two adjacent sectors being provided at its other end with a notch for accommodating one of said two stops, the wedging of the sectors between the stops maintaining the sectors in a disc formation on the wheel.

2. The device of claim 1, wherein the wedges are detachably maintained in position by elements screwed in the wheel.

3. The device of claim 2, wherein said elements comprise bolts of which the heads abut on the wedges in radial direction and of which the shanks are screwed in the wheel.

4. The device of claim 1, comprising sectors on the two faces of the wheel, each sector of one face forming with a corresponding sector of the other face a unit which covers the wheel.

5. The device of claim 4, wherein each pair of said sectors is fast with a rim portion.

6. The device of claim 1, wherein each sector is fast with a rim portion.

7. A trenching machine wheel assembly comprising:

a wheel;

sectors to which trenching tools are fixed, each sector having the shape of a portion of a disc; and means for fixing the sectors adjacent to each other on at least one face of the wheel in a disc formation, said fixing means comprising stops connected to the wheel and wedges positioned between adjacent sectors, said stops and wedges being disposed alternatively around the periphery of the at least one face of the wheel, two adjacent sectors being located between two stops and in abutment therewith under the action of one of the wedges radially inserted between adjacent ends of said two adjacent sectors, each of said two adjacent sectors being provided at its other end with a notch for accommodating one of said two stops, the wedging of the sectors between the stops maintaining the sectors in a disc formation on the wheel.

* * * * *